US007451732B1

(12) United States Patent
Vichinsky et al.

(10) Patent No.: US 7,451,732 B1
(45) Date of Patent: Nov. 18, 2008

(54) MULTI-SHELL AIR INTAKE MANIFOLD WITH PASSAGE FOR MAP SENSOR AND METHOD OF PRODUCING SAME

(75) Inventors: Kevin Vichinsky, Portage, MI (US); Dan Huff, Kalamazoo, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 12/022,481

(22) Filed: Jan. 30, 2008

(51) Int. Cl.
*F02M 35/10* (2006.01)

(52) U.S. Cl. ..... 123/184.47; 123/184.42

(58) Field of Classification Search ..... 123/184.21–184.61
See application file for complete search history.

(56) References Cited

U.S. PATENT DOCUMENTS

| | | | | |
|---|---|---|---|---|
| 4,840,146 | A * | 6/1989 | Yanagisawa et al. | 123/336 |
| 5,003,933 | A * | 4/1991 | Rush et al. | 123/184.42 |
| 5,038,725 | A * | 8/1991 | Okazaki et al. | 123/184.61 |
| 5,094,194 | A * | 3/1992 | Rush et al. | 123/184.42 |
| 5,150,669 | A * | 9/1992 | Rush et al. | 123/184.42 |
| 5,261,272 | A * | 11/1993 | Rush et al. | 73/114.34 |
| 5,575,249 | A * | 11/1996 | Mielke et al. | 123/184.57 |
| 5,636,605 | A * | 6/1997 | Nomizo et al. | 123/184.61 |
| 5,765,372 | A * | 6/1998 | Mitobe et al. | 60/301 |
| 6,199,530 | B1 * | 3/2001 | Brassell et al. | 123/184.34 |
| 6,267,093 | B1 * | 7/2001 | Lohr | 123/184.61 |
| 6,308,686 | B1 * | 10/2001 | Mammarella et al. | 123/470 |
| 6,330,825 | B1 * | 12/2001 | Harness et al. | 73/114.13 |
| 6,427,655 | B2 * | 8/2002 | Itoh et al. | 123/184.42 |
| 6,467,449 | B2 * | 10/2002 | Brassell et al. | 123/184.61 |
| 6,739,301 | B2 * | 5/2004 | Brassell et al. | 123/184.61 |
| 6,782,862 | B2 * | 8/2004 | Homi | 123/184.47 |
| 6,805,089 | B2 * | 10/2004 | Kemper et al. | 123/184.61 |
| 6,988,478 | B2 * | 1/2006 | Tanikawa et al. | 123/184.42 |
| 7,021,263 | B1 * | 4/2006 | Agnew et al. | 123/184.47 |
| 7,055,499 | B1 * | 6/2006 | Kuwano et al. | 123/399 |
| 7,270,102 | B2 * | 9/2007 | Tanikawa et al. | 123/184.42 |
| 7,305,958 | B2 * | 12/2007 | Doko et al. | 123/184.21 |
| 2003/0010321 | A1 * | 1/2003 | Rentschler et al. | 123/472 |

* cited by examiner

*Primary Examiner*—George Nguyen
*Assistant Examiner*—David Hamaoui
(74) *Attorney, Agent, or Firm*—Crowell & Moring LLP

(57) ABSTRACT

An air intake manifold assembly for an internal combustion engine composed of a plurality of molded synthetic resin shells assembled to each other so as to define a plenum chamber, a plurality of inlet channels leading from said plenum chamber to cylinder inlets of the internal combustion engine, and a throttle body passageway leading from a throttle body mount into the plenum chamber; with a groove formed in a surface of at least one of the shells facing an adjacent shell and extending from an inlet opening to the throttle body passageway or the plenum chamber so as to form an elongate passage between the assembled shells leading from the inlet to the throttle body passage or plenum chamber, and a method of forming such an intake manifold assembly.

20 Claims, 4 Drawing Sheets

MULTI-SHELL AIR INTAKE MANIFOLD WITH PASSAGE FOR MAP SENSOR AND METHOD OF PRODUCING SAME

BACKGROUND OF THE INVENTION

Light weight and durable intake manifolds for internal combustion engines can be constructed of moldable thermoplastic synthetic resin material. Such intake manifolds may be constructed of a plurality of molded sections or shells which are joined together, for example, by vibration welding, friction welding or sonic welding. Typically, such intake manifolds are made up of three sections: an upper shell, a middle shell and a lower shell. A plenum chamber is formed between the middle and lower shells, and a plurality of intake channels which lead to the individual cylinders of the engine are formed between the upper and middle shells.

Intake manifolds require inlet openings for attached sensors such as a manifold absolute pressure sensor (MAP sensor) and/or introduction of secondary gases such as purge gases from an evaporative emission control system into the manifold. The MAP sensor provides manifold pressure information to a fuel injected engine's electronic control unit which is used to compute air density and determine the engine's air mass flow rate in order to calculate the appropriate fuel flow. The purge gas inlet is connected to the fuel vapor storage canister of the evaporative emission control system and allows a vacuum within the manifold to draw stored fuel vapors from the canister into the manifold to be mixed with the normal fuel/air mixture burned in the engine. In conventional intake manifolds, the MAP sensor and purge gas connections comprise individual passages in the upper shell of the manifold which open into the throttle body passage. The MAP and purge gas passages are each formed by a long, round pin in the upper shell molding tool to create the respective passage. To enable opening of the mold and ejection of the molded section, the pin typically is mounted on a retractable slide in the molding tool. Production of such molding tools involves high tooling costs. Also, the pin is a very high maintenance due to wear of the tool, and if the passage is long, it makes the pin easier to break.

SUMMARY OF THE INVENTION

The present invention broadly comprises an air intake manifold assembly for an internal combustion engine; the intake manifold assembly comprising a plurality of molded synthetic resin shells assembled to each other and defining a plenum chamber, a plurality of inlet channels leading from the plenum chamber to cylinder inlets of the internal combustion engine, and a throttle body passageway leading from a throttle body mount into the plenum chamber; in which a groove is formed in a surface of at least one of the shells facing an adjacent shell; the groove extending from an inlet opening to the throttle body passageway or the plenum chamber and forming an elongate passage between the assembled shells leading from the inlet to the throttle body passage or plenum chamber.

In another aspect, the invention comprises a method of producing an air intake manifold assembly for an internal combustion engine, comprising molding a plurality of shells of synthetic resin material, and joining the shells together to form an assembly defining a plenum chamber, a plurality of inlet channels for conveying air to cylinder inlets of the internal combustion engine, and a throttle body passageway leading from a throttle body mount to the plenum chamber; wherein a groove is formed in a surface of at least one of the shells facing an adjacent shell; the groove extending from an inlet opening to the throttle body passageway or the plenum chamber and forming an elongate passage between the shells leading from said inlet to the throttle body passage or plenum chamber when the shells are joined together.

In accordance with the invention, at least one passage for a MAP sensor or purge gas introduction is constructed between the upper and middle shells of an intake manifold constructed of a plurality of molded synthetic resin shells. The passage may be constructed by a groove in either the upper shell or in the middle shell or by registering grooves in both the upper and middle shells so that part of the passage is in the upper shell and part in the middle shell. By designing the passage so that it is formed between the shells, it is possible to create a passage without the use of a pin. Also, by creating the passage in this manner, the placement of the MAP sensor and purge gas connector is less restricted, and it becomes possible to locate them in more convenient locations.

The present invention uses two mating shells with an open groove in the facing surface of at least one of the shells to create a passageway. The mating shells are vibration or friction welded to each other to form the passageway between them. Advantages of the invention include (1) easier manufacturing, (2) the location of the MAP and purge connections is less limited, and (3) decreased tooling cost. The invention can be used with any synthetic resin intake manifold formed from a plurality of molded shells assembled to each other.

It is particularly advantageous if the groove is oriented substantially perpendicular to the line of draw of the mold in which the shell is formed. This eliminates undercuts and facilitates opening of the mold and ejection of the molded manifold section. As used herein, the term "line of draw" refers to an imaginary line which indicates the direction in which the mold is opened.

The shells of the manifold assembly may be formed of any suitable moldable synthetic resin material. A particularly preferred material is a polyamide such as nylon 6-6.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
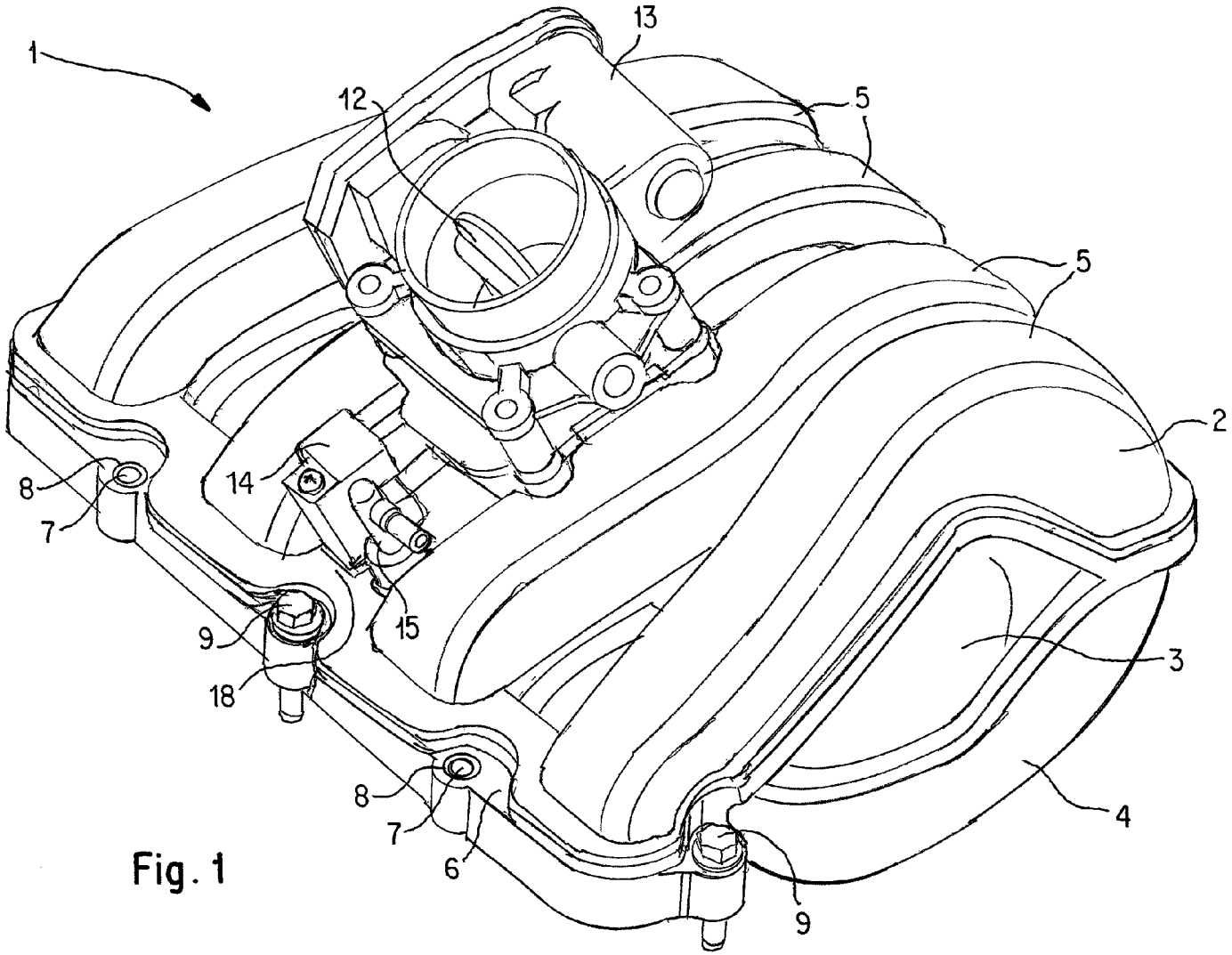
FIG. 1 is a perspective view of a multi-shell synthetic resin air intake manifold assembly constructed in accordance with the present invention.
Figure 2:
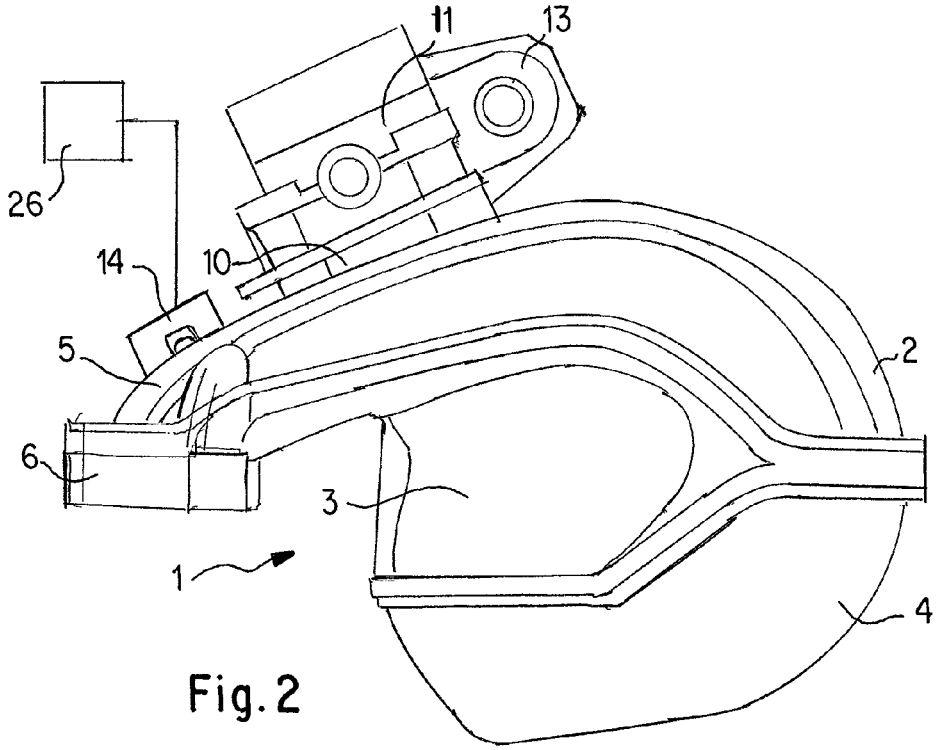
FIG. 2 is a side elevation view of the intake manifold assembly of FIG. 1.

FIGS. 1 and 2 show an internal combustion engine air intake manifold 1 according to the present invention, which comprises an assembly of an upper shell 2, a middle shell 3 and a lower shell 4 of molded synthetic resin material. The assembled upper and middle shells define a plurality of individual inlet channels 5 which lead from an internal plenum chamber to inlets of cylinders of the engine. The inlet channels 5 terminate at a mounting flange 6, which can be fastened to the cylinder head of an internal combustion engine by mounting bolts 9 extended through mounting bolt holes 7 in flange 6. Mounting holes 7 may be provided with reinforcing bushings 8. A throttle body 11, comprising a throttle flap valve 12 and a throttle controller 13, is mounted on a throttle body mount 10 on top of upper shell 2.

Mounted on top of the manifold assembly 1 is a MAP sensor 14, which is connected to an engine control module 26 and serves to detect the manifold air pressure and transmits this information to control module 26 for use in controlling the fuel supply to the engine. MAP sensor 14 is positioned on a connecting web 18 between two inlet channels 5 and communicates with the interior of the manifold through a MAP passage described in further detail hereinafter.

A purge gas connection 15 is also mounted on top of manifold assembly 1 on connecting web 18. Purge gas connection 15 likewise communicates with the interior of manifold assembly 1 through a purge gas passage.

Figure 3:
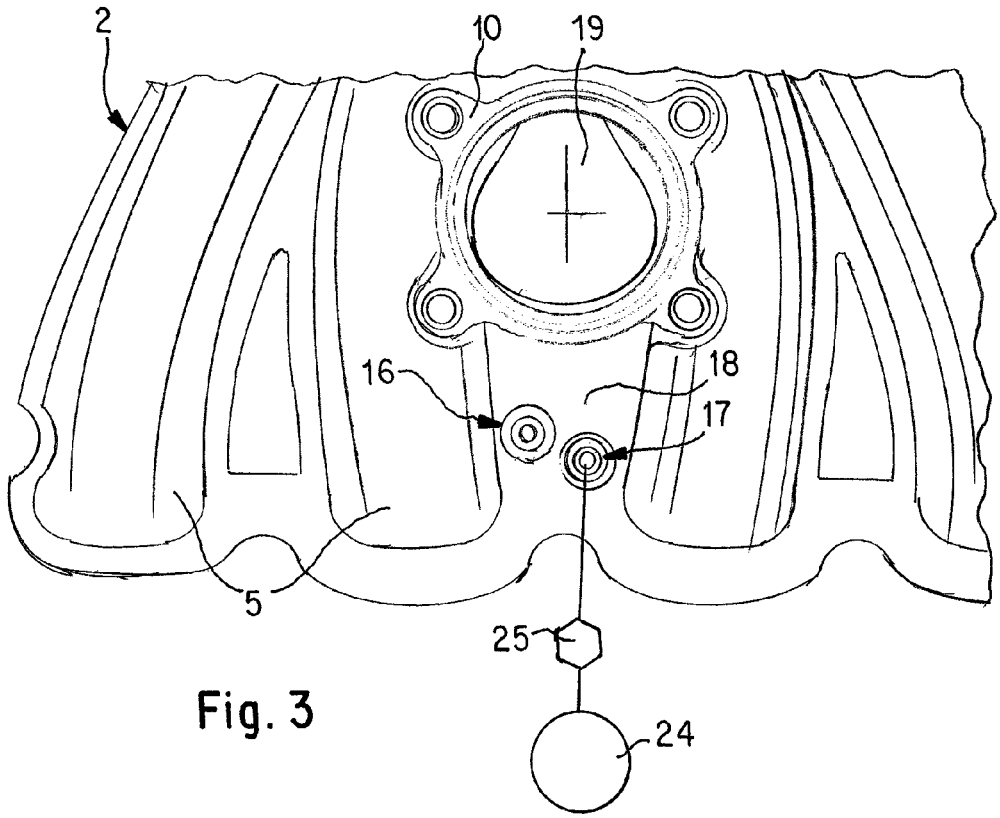
FIG. 3 is a top view of the upper shell of the intake manifold.
Figure 4:
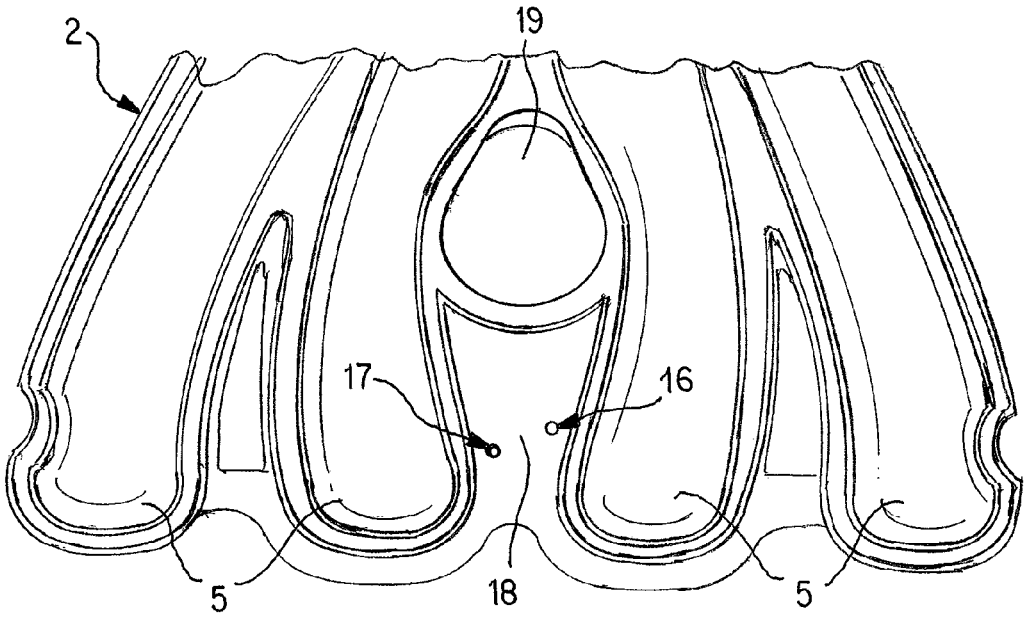
FIG. 4 is a bottom view of the upper shell of the intake manifold.

The upper shell 2 of manifold assembly 1 is illustrated in FIGS. 3 and 4, with FIG. 3 showing a top view, and FIG. 4 showing a bottom view. The figures show the individual inlet channels 5 as well as the connecting web 18. In web 18 can be seen the inlet opening 16 at which the MAP sensor 14 is mounted and through which the MAP sensor communicates with the MAP passage leading to the interior of manifold 1. Similarly, purge gas connector inlet opening 17, through which the purge gas connector 15 communicates with the purge gas passage, can be seen on web 18. Additionally, the MAP passage and/or the purge gas passage may be linear.

FIG. 3 schematically illustrates how the purge gas connector 15 is connected to a fuel vapor canister 24 of an evaporative emission control system via a purge control valve 25 so that fuel vapors stored in the canister 24 can be drawn into the manifold 1 by the manifold vacuum when the purge control valve 25 is opened. Control valve 25 may be either a thermo vacuum valve (TVV) or a vacuum switching valve (VSV) under the control of the electronic engine control system. Also visible in FIGS. 3 and 4 is the throttle body passageway 19, which leads from the throttle body mount 10 to the plenum chamber in the interior of intake manifold assembly 1.

Figure 5:
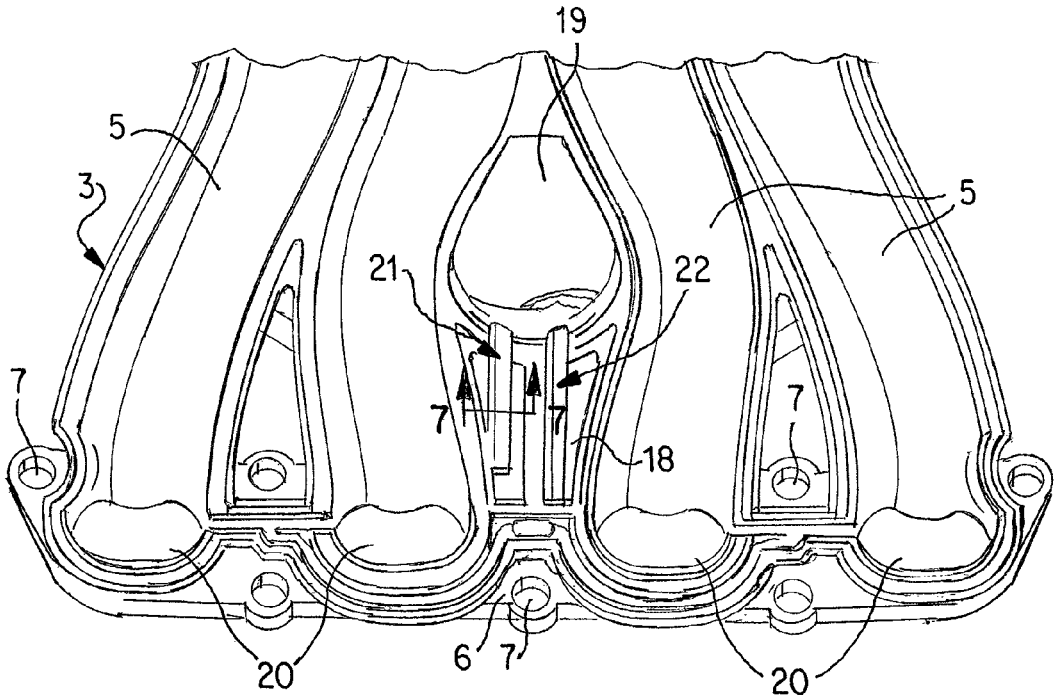
FIG. 5 is top view of the middle shell of the intake manifold.

FIG. 5 is a top view of middle shell 3 of intake manifold assembly 1. The top surface of middle shell 3 is constructed to mate with the bottom surface of upper shell 2, whereby the inlet channels 5 are formed between the two shells 2 and 3. When mounting flange 6 is secured to the cylinder head of an internal combustion engine (not shown), inlet channels 5 lead from the plenum chamber of the manifold assembly to respective cylinder inlets 20.

Middle shell 3 is likewise provided with a connecting web 18 between two inlet channels 5. The upper surface of connecting web 18 of middle shell 3 is provided with two recesses or grooves 21 and 22. Groove 21 is the MAP passage groove and is arranged so as to lead from the MAP inlet opening 16 to the throttle body passageway 19. Groove 22 is the purge gas passage groove and is arranged to lead from the purge gas connector inlet opening 17 to the throttle body passageway 19. When upper shell 2 is mated to middle shell 3, the underside of connecting web 18 of upper shell 2 engages the top of connecting web 18 of middle shell 3, so that grooves 21 and 22 form closed elongate passages which lead from the respective inlet openings 16 and 17 to the throttle body passageway 19. Thus, a MAP sensor 14 mounted at MAP inlet opening 16 and a purge gas connector 15 mounted at purge inlet opening 17 can communicate with the interior of the manifold despite being positioned away from the throttle body passageway 19. In this way, considerable design freedom regarding the placement of the MAP sensor and/or the purge gas connector can be achieved in a simple and cost effective manner.

Preferably, the MAP passage will have a minimum diameter of 5 mm, particularly preferably at least 5.5 mm, but it may be made larger or smaller as desired.

Figure 6:
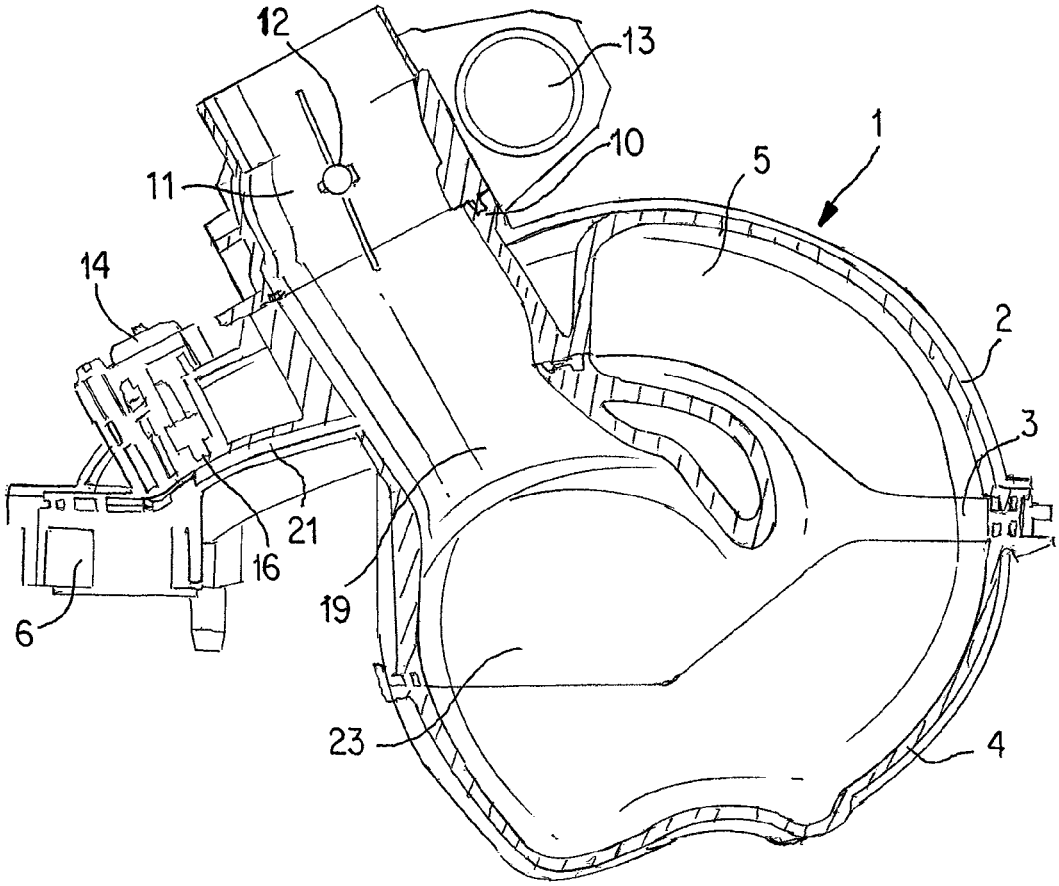
FIG. 6 is a sectional side view of the intake manifold assembly.

FIG. 6 is a sectional side view of the intake manifold assembly 1 showing how plenum chamber 23 is formed between middle shell 3 and lower shell 4 and how inlet channels 5 are formed between upper shell 2 and middle shell 3. FIG. 6 also clearly shows how throttle body passageway 19 communicates between the throttle body 11 and the plenum chamber 23.

MAP sensor 14 is mounted on upper shell 2 over the MAP inlet opening 16 so that it can communicate with the MAP passage formed by groove 21 in middle shell 3 leading to throttle body passage way 19. Thus, the MAP sensor can sense the manifold absolute pressure in the interior of manifold assembly and transmit an appropriate signal to the engine control module.

Figure 7:
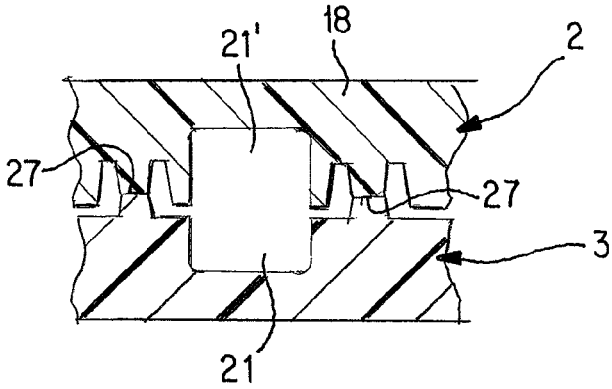
FIG. 7 is a partial sectional view of registering grooves in an alternate embodiment of the invention.

FIG. 7 is a sectional partial view through the connecting webs 18 of upper shell 2 and middle shell 3 of an alternative embodiment of the present invention. In this embodiment, in addition to the MAP passage groove 21 formed in middle shell 3, a corresponding groove 21' is also formed in connecting web 18 of upper shell 2. When upper shell 2 and middle shell 3 are mated with each other, the two grooves 21 and 21' are in registration with each other so that together they form an enlarged MAP passage between the two shells. Although the two grooves 21 and 21' are shown as substantially equal in size so that approximately one half of the MAP passage is formed in the upper shell and the other half is in the lower shell, if desired, the relative proportions of the two grooves can be adjusted to vary the parts of the passage in each shell. After initial assembly, shells 2 and 3 are permanently joined to each other by friction welding at weld points 27. Similar welded joints are formed between upper shell 2 and middle shell 3, and between middle shell 3 and lower shell 4, around the periphery of the shells to permanently join the assembled shells into a unitary intake manifold.

In operation, combustion air from an air filter (not shown) is drawn through throttle body 11 and throttle body passageway 19 to plenum chamber 23 in the interior of the manifold assembly 1. From the plenum chamber the combustion air passes through the individual inlet channels 5 to the respective cylinder inlets 20 of the engine. Because the MAP sensor is in fluid communication with the interior of the manifold through the MAP passage formed by MAP passage groove 21 and the through the throttle body passageway 19, the MAP sensor can sense the absolute pressure inside the air intake manifold and transmit the sensed value to the engine control module 26. The control module uses the sensed pressure value together with other information to compute the amount of fuel required by the engine and sends an appropriate control signal to the fuel injectors.

When the position of the accelerator pedal is changed, throttle controller 13 moves the throttle flap valve 12 inside throttle body 11 to adjust the throttle opening. This changes the flow of air into the plenum chamber and consequently the pressure conditions inside the intake manifold will also change. The MAP sensor detects the changed pressure condition and transmits the sensed value to engine control module 26 where it is used in conjunction with other information to appropriately adjust the fuel supply to the engine to reflect the changed combustion airflow and operating state of the engine.

When the reaches a suitable operating condition, purge control valve 25 is opened to permit fluid communication between the fuel vapor storage canister 24 and the interior of the intake manifold. The vacuum generated in the manifold can thus draw purge air through the canister 24, the control valve 25, the purge gas connector 15, and the passage formed by purge gas passage groove 22 into the throttle body passageway 19 and the plenum chamber 23. The purge air picks up stored fuel vapors from the canister 24 and carries them to the interior of the intake manifold where they mix with the combustion air and then are combusted in the engine.

The air intake manifold assembly of the invention is produced as follows. First the individual shells are molded from a suitable thermoplastic synthetic resin such as nylon 66. The molds are constructed so that at least one groove is formed in a surface of at least one of the shells. The shells are then assembled to each other to form an assembly defining a plenum chamber, a plurality of inlet channels for conveying air to cylinder inlets of the internal combustion engine, and a throttle body passageway leading from a throttle body mount to the plenum chamber. The assembly is carried out such that the shell surface in which the groove has been formed mates with the facing surface of an adjoining shell to produce a closed elongate passage leading from an inlet opening in one of the shells to the throttle body passageway or to the plenum chamber formed inside the assembly of shells. The assembled shells are then joined to each other, preferably by a welding technique such as vibration welding, friction welding or sonic welding. Additional components such as a throttle body, a MAP sensor and/or a purge gas connector can be attached either to the individual shells prior to assembly or to the assembled shells, as desired.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An air intake manifold assembly for an internal combustion engine; said intake manifold assembly comprising a plurality of molded synthetic resin shells assembled to each other; said intake manifold assembly defining a plenum chamber, a plurality of inlet channels leading from said plenum chamber to cylinder inlets of the internal combustion engine, and a throttle body passageway leading from a throttle body mount into the plenum chamber; wherein a groove is formed in a surface of at least one of said shells facing an adjacent shell; said groove extending from an inlet opening to the throttle body passageway or the plenum chamber and forming an elongate passage between the assembled shells leading from said inlet to the throttle body passage or plenum chamber.

2. An air intake manifold assembly as claimed in claim 1, wherein said shells are joined to each other by friction welding or vibration welding.

3. An air intake manifold assembly as claimed in claim 1, wherein said assembly comprises an upper shell, a middle shell and a lower shell, with said plurality of inlet channels formed between the upper and middle shells, and said plenum chamber formed between the middle and lower shells.

4. An air intake manifold assembly as claimed in claim 3, wherein said groove is formed in an upper surface of said middle shell facing a lower surface of said upper shell.

5. An air intake manifold assembly as claimed in claim 1, further comprising a throttle body mounted on said throttle body mount for controlling admission of air through said throttle body passage way into the plenum chamber.

6. An air intake manifold assembly as claimed in claim 1, further comprising a manifold absolute pressure sensor mounted at the inlet opening and communicating with the interior of said intake manifold through said elongate passage.

7. An air intake manifold assembly as claimed in claim 6, wherein said passage has a minimum diameter of at least 0.5 mm.

8. An air intake manifold assembly as claimed in claim 7, wherein said passage has a minimum diameter of at least 5.5 mm.

9. An air intake manifold assembly as claimed in claim 6, wherein said manifold absolute pressure sensor is connected to an engine control module for controlling fuel supply to engine fuel injectors depending on the mass of air supplied to the engine through the intake manifold assembly.

10. An air intake manifold assembly as claimed in claim 1, further comprising a purge gas connector mounted at the inlet opening and communicating with the interior of said intake manifold through said elongate passage.

11. An air intake manifold assembly as claimed in claim 10, wherein said purge gas connector is connected to a canister for collecting and storing fuel vapors, whereby a vacuum developed in said intake manifold can draw fuel vapors from said canister to said manifold so the fuel vapors can be fed to the internal combustion engine.

12. An air intake manifold assembly as claimed in claim 1, wherein said groove is substantially perpendicular to the line of draw of the molded shell in which it is formed.

13. An air intake manifold assembly as claimed in claim 1, wherein registering grooves are formed in facing surfaces of two adjacent shells, whereby said registering grooves together form said elongate passage.

14. An air intake manifold assembly as claimed in claim 1, wherein said elongate passage opens into the throttle body passageway.

15. An air intake manifold assembly as claimed in claim 1, wherein said elongate passage is a linear passage.

16. An air intake manifold assembly as claimed in claim 1, wherein two grooves are formed in said surface of said at least one shell, each of said grooves extending from a respective inlet opening to the throttle body passageway or the plenum chamber, whereby said grooves form two elongate passages between the assembled shells, each of said two passages leading from a respective one of the inlet openings to the throttle body passage or plenum chamber.

17. An air intake manifold assembly as claimed in claim 16, further comprising:

a manifold absolute pressure sensor mounted at one of said inlet openings and communicating with the interior of said intake manifold through one of said elongate passages, and a purge gas connector mounted at the other of said inlet openings and communicating with the interior of said intake manifold through the other of said two elongate passages.

18. A method of producing an air intake manifold assembly for an internal combustion engine, said method comprising:

molding a plurality of shells of synthetic resin material;

joining said shells together to form an assembly defining a plenum chamber, a plurality of inlet channels for conveying air to cylinder inlets of the internal combustion engine, and a throttle body passageway leading from a throttle body mount to the plenum chamber;

wherein a groove is formed in a surface of at least one of said shells facing an adjacent shell; said groove extending from an inlet opening to the throttle body passageway or the plenum chamber and forming an elongate passage between the shells leading from said inlet to the throttle body passage or plenum chamber when the shells are joined together.

19. A method as claimed in claim 18, wherein said shells are joined together by friction welding or vibration welding.

20. A method as claimed in claim 18, wherein said plurality of shells comprises an upper shell, a middle shell and a lower shell, with said plurality of inlet channels formed between the upper and middle shells, and said plenum chamber formed between the middle and lower shells.

* * * * *